US006734627B2

(12) United States Patent
Ahn

(10) Patent No.: US 6,734,627 B2
(45) Date of Patent: May 11, 2004

(54) PLASMA DISPLAY PANEL

(75) Inventor: Young Joon Ahn, Gumi-si (KR)

(73) Assignee: LG Electronics Inc., Seoul (KR)

( * ) Notice: Subject to any disclaimer, the term of this patent is extended or adjusted under 35 U.S.C. 154(b) by 32 days.

(21) Appl. No.: 10/255,637

(22) Filed: Sep. 27, 2002

(65) Prior Publication Data

US 2003/0062835 A1 Apr. 3, 2003

(30) Foreign Application Priority Data

Sep. 28, 2001 (KR) ..... 2001-0060721

(51) Int. Cl.[7] ..... H01J 17/49
(52) U.S. Cl. ..... 313/587; 313/585
(58) Field of Search ..... 313/582, 584, 313/585, 586, 587; 315/169.4; 345/41, 60

(56) References Cited

U.S. PATENT DOCUMENTS 5,952,782 A * 9/1999 Nanto et al. ..... 313/584
5,972,528 A * 10/1999 Kim ..... 428/697
5,977,708 A * 11/1999 Amatsu et al. ..... 313/586
6,344,713 B1 * 2/2002 Awaji et al. ..... 313/582
6,411,030 B1 * 6/2002 Van Leeuwen et al. ..... 313/582
6,433,477 B1 * 8/2002 Ha et al. ..... 313/586

* cited by examiner

*Primary Examiner*—Ashok Patel
(74) *Attorney, Agent, or Firm*—Fleshner & Kim, LLP

(57) ABSTRACT

The present invention relates to a plasma display panel to improve its light emission efficiency and lower its driving voltage. The plasma display panel of the present invention has electrodes formed on a front substrate. The electrodes of the plasma display panel include first electrodes for receiving scan pulses, second electrodes for receiving first sustain pulses and third electrodes for receiving second sustain pulses. The first dielectric sub-layer formed on a backside of the first electrodes is formed thinner than the second dielectric sub-layer formed on backsides of the second electrodes and the third electrodes.

21 Claims, 4 Drawing Sheets

PLASMA DISPLAY PANEL

BACKGROUND OF THE INVENTION

1. Field of the Invention

The present invention relates to a plasma display panel, and more particularly, to a plasma display panel having different dielectrics formed on a front substrate so as to improve its light emission efficiency and lower its driving voltage.

2. Description of the Related Art

In general, a plasma display panel (hereafter, referred to as PDP) is a display device using the visible rays generated when vacuum ultraviolet rays generated by gas discharge excite phosphor.

The PDP is thinner in thickness and lighter in weight than the cathode ray tubes (CRTs) that have been usually employed as display devices. The PDP has an advantage in that a high definition and large-sized screen can be realized.

The PDP that has such advantages described above includes many discharge cells arranged in matrix fashion and each of the discharge cells works as one pixel of a screen.

FIGS. 1 and 2 illustrate the structure of three-electrode AC surface discharge type PDP in the related art respectively. Specifically, FIG. 2 is a drawing in which a front substrate is turned by 90° to a rear substrate to describe a whole schematic structure of the discharge cells. Even though FIGS. 1 and 2 depict one discharge cell 1 for the convenience of explanation, a PDP has generally many millions of the discharge cells 1 shown in the FIGS. 1 and 2 arranged in matrix fashion.

Referring to FIGS. 1 and 2, a three-electrode AC surface discharge type PDP in the related art includes first electrodes 12Y and second electrodes 12Z formed on a front substrate 10 and address electrodes 20X formed on a rear substrate 18.

A front dielectric layer 14 and a protective layer 16 are laminated on the front substrate 10 that has the first electrodes 12Y and the second electrodes 12Z arranged in parallel. Wall charge generated during plasma discharge is stored on the front dielectric layer 14. The front dielectric layer 14 is designed to have a thickness within 30 $\mu$m to 45 $\mu$m. The protective layer 16 protects the front dielectric layer 14 from damages caused by sputtering during plasma discharge and also improves the second electrons emission efficiency. The protective layer 16 is usually made of magnesium oxide (MgO).

A rear dielectric layer 22 and barrier ribs 24 are formed on the rear substrate 18 that has the address electrodes 20X formed thereon. A phosphor layer 26 is coated on the surfaces of the rear dielectric layer 22 and the barrier ribs 24. The address electrodes 20X is formed in the direction to cross over the first electrodes 12Y and the second electrodes 12Z. The barrier ribs 24 are formed in parallel with the address electrodes 20X so as to prevent the ultraviolet rays and the visible rays generated by the plasma discharge from leaking into the neighboring discharge cells 1.

The phosphor layer 26 is excited by the ultraviolet rays generated during the plasma discharge so as to generate one of visible rays of red, green and blue colors. The inert gas for discharge is injected into discharge spaces prepared between the front substrate 10/the rear substrate 18 and the barrier ribs 24. A black matrix not shown in the FIGS. 1 and 2 is formed between the first electrode 12Y and the second electrode 12Z which are respectively formed in the neighboring discharge cells 1.

In this AC surface discharge type PDP, one frame is divided into a few subfields each of which is different from others in the number of discharge times so as to display the gray levels of images. Each of the subfields is divided into a reset period for generating a uniform discharge, an address period for selecting a discharge cell, and a sustain period for displaying gray levels according to the number of discharge times. For example, to display an image in 256 gray levels, the frame period (16.67 ms) corresponding to one 60th second is divided into eight subfields.

Each of the eight subfields is divided into the reset period, the address period and a sustain period. The reset period of each subfield is the same as the address period in length while the sustain period increases at each subfield at the ratio of $2^n$(n=0, 1, 2, 3, 4, 5, 6 and 7). In this way, the sustain period of each field is different from that of other fields, and hence the gray levels of the image can be displayed.

In the reset period, reset pulses are applied to the first electrodes 12Y to cause reset discharge. In the address period, scan pulses are applied to the first electrodes 12Y and data pulses are applied to the address electrodes 20X to cause address discharge between two electrodes 12Y and 20X. The wall charge is created on the front dielectric layer 14 and the rear dielectric layer 22 during the address discharge. In the sustain period, AC signals that are alternatively applied to the first electrodes 12Y and the second electrodes 12Z cause sustain discharge between two electrodes 12Y and 12Z.

Such a PDP in the related art varies in its light emission efficiency and its driving voltage according to the thickness of the front dielectric layer 14. For example, when the front dielectric layer 14 is formed to be thicker than a predetermined thickness, the discharge current that is applied to the PDP during the sustain period allows the wall charge to be generated uniformly on the entire areas of the first electrodes 12Y and the second electrodes 12Z and hence the wall charge enhance the brightness very greatly. However, if the front dielectric layer 14 is formed to be thicker than a predetermined thickness, the thick front dielectric layer 14 may allow a high voltage to be applied in order to cause address discharge between the first electrodes 12Y and address electrodes 20X during address period.

On the other hand, when the front dielectric layer 14 is formed to be thinner than a predetermined thickness, the discharge current that is applied to the PDP during the sustain period results in the wall charge's concentration on the inner edge portions of the first electrodes 12Y and the second electrodes 12Z. This is not expected to enhance the brightness. However, if the front dielectric layer 14 is farmed to be thinner than a predetermined thickness, the thin front dielectric layer 14 may allow a low voltage to be applied in order to cause address discharge between the first electrodes 12Y and address electrodes 20X during address period.

Thus, in the PDP of the related art, if the front dielectric layer 14 is formed to be thick, the higher driving voltage is required to cause address discharge. In contrast, if the front dielectric layer 14 is formed to be thin in order to lower the driving voltage required to cause the address discharge, the discharge efficiency degenerates. Therefore, in the PDP of the related art, it is impossible to enhance the light emission efficiency and lower the driving voltage at the same time.

SUMMARY OF THE INVENTION

An object of invention is to solve at least the above problems and/or disadvantages and to provide at least the advantages described hereinafter.

Accordingly, it is an object of the present invention to enhance the light emission efficiency and lower the driving voltage at the same time in PDP.

These and other objects and advantages of the invention are achieved by providing a plasma display panel which includes: a plurality of first electrodes formed on a front substrate, for receiving scan pulses during address period; a plurality of second electrodes formed near to each of the first electrodes, for receiving first sustain pulses during sustain period; a plurality of third electrodes formed spaced widely from each of the second electrodes, for receiving second sustain pulses during sustain period; a dielectric layer having a first dielectric sub-layer and a second dielectric sub-layer, the first dielectric sub-layer being formed on a backside of the first electrodes, the second dielectric sub-layer being formed on backsides of the second electrodes and the third electrodes, the first dielectric sub-layer being different from the second dielectric sub-layer in thickness; a plurality of address electrodes formed on a rear substrate in a direction to cross over the first electrodes, the second electrodes and the third electrodes; and a plurality of barrier ribs formed between the neighboring address electrodes and parallel with the address electrodes.

It is desired that the first dielectric sub-layer is thinner than the second dielectric sub-layer.

It is desired that the first dielectric sub-layer is arranged in a stripe shape and parallel with the first electrodes.

It is desired that the second dielectric sub-layer is arranged in a stripe shape and parallel with the second electrodes and third electrodes.

It is desired that the dielectric layer gets gradually thicker with a predetermined slope at a boundary area between the first sub-dielectric layer and the second sub-dielectric layer as it goes from the first dielectric sub-layer to the second dielectric sub-layer.

It is desired that the dielectric layer gets abruptly thicker with a stiff step at a boundary area between the first sub-dielectric layer and the second sub-dielectric layer as it goes from the first dielectric sub-layer to the second dielectric sub-layer.

According to another aspect of the invention, a plasma display panel includes: a plurality of first electrodes formed on a front substrate, for receiving scan pulses during address period; a plurality of second electrodes formed near to each of the first electrodes, for receiving first sustain pulses during sustain period; a plurality of third electrodes formed spaced widely from each of the second electrodes, for receiving second sustain pulses during sustain period; a dielectric layer having a first dielectric sub-layer and a second dielectric sub-layer, the first dielectric sub-layer being formed on a backside of the first electrodes, the second dielectric sub-layer being formed on backsides of the second electrodes and the third electrodes, the dielectric layer getting gradually thicker with a predetermined slope at a boundary area between the first sub-dielectric layer and the second sub-dielectric layer as it goes from the first dielectric sub-layer to the second dielectric sub-layer; a plurality of address electrodes formed on a rear substrate in a direction to cross over the first electrodes, the second electrodes and the third electrodes; and a plurality of barrier ribs formed between the neighboring address electrodes and parallel with the address electrodes.

According to further another aspect of the invention, a plasma display panel includes: a plurality of first electrodes formed on a front substrate, for receiving scan pulses during address period; a plurality of second electrodes formed near to each of the first electrodes, for receiving first sustain pulses during sustain period; a plurality of third electrodes formed spaced widely from each of the second electrodes, for receiving second sustain pulses during sustain period; a dielectric layer having first dielectric sub-layer and second dielectric sub-layer, the first dielectric sub-layer being formed on a backside of the first electrodes, the second dielectric sub-layer being formed on backsides of the second electrodes and the third electrodes, the dielectric layer getting abruptly thicker with a stiff step at a boundary area between the first sub-dielectric layer and the second sub-dielectric layer as it goes from the first dielectric sub-layer to the second dielectric sub-layer in their boundary areas, the first dielectric sub-layer being thinner than the second dielectric sub-layer; a plurality of address electrodes formed on a rear substrate in a direction to cross over the first electrodes, the second electrodes and the third electrodes; and a plurality of barrier ribs formed between the neighboring address electrodes and parallel with the address electrodes.

It is desired that the first dielectric sub-layer and the second dielectric sub-layer are formed only in discharge between the neighboring barrier ribs.

According to still another aspect of the invention, a plasma display panel includes: a plurality of first electrodes formed on a front substrate, for receiving scan pulses during address period; a plurality of second electrodes formed near to each of the first electrodes, for receiving first sustain pulses during sustain period; a plurality of third electrodes formed spaced widely from each of the second electrodes, for receiving second sustain pulses during sustain period; a dielectric layer having first dielectric sub-layer and second dielectric sub-layer, the first dielectric sub-layer being formed on a backside of the first electrodes, the second dielectric sub-layer being formed on backsides of the second electrodes and the third electrodes, the first dielectric sub-layer being thinner than the second dielectric sub-layer, the first dielectric sub-layer and the second dielectric sub-layer being formed only in discharge cells between the neighboring barrier ribs; a plurality of address electrodes formed on a rear substrate in a direction to cross over the first electrodes the second electrodes and the third electrodes; and a plurality of barrier ribs formed between the neighboring address electrodes and parallel with the address electrodes.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The following detailed description will present a preferred embodiment of the invention in reference to the accompanying drawings.

DETAILED DESCRIPTION OF THE PREFERRED EMBODIMENTS

Reference will now be made in detail to a preferred embodiment of the present invention.

Figure 1:
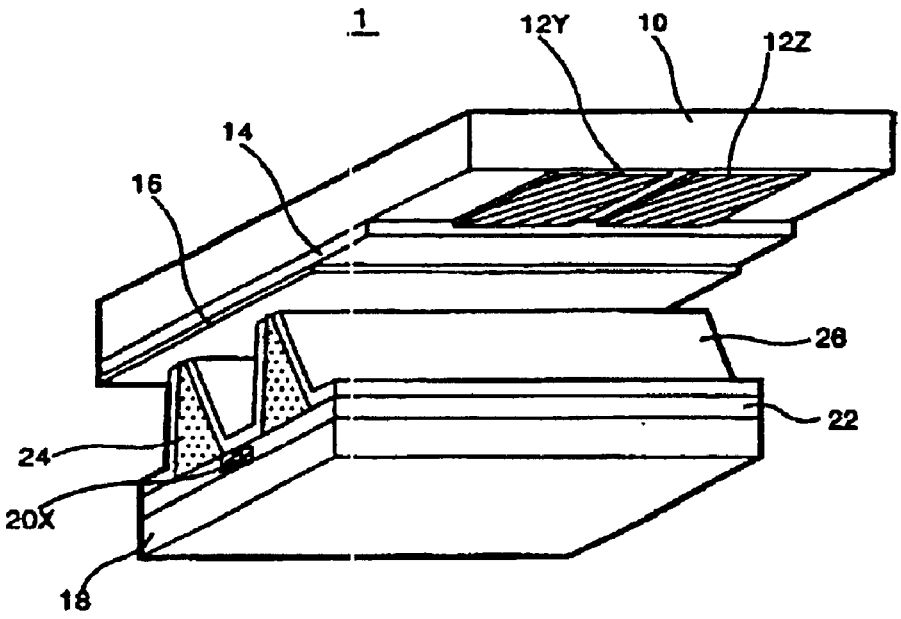
Fig. 1(Related Art)
FIG. 1 is an exploded perspective view of the three-electrode AC surface discharge type PDP of the prior art.
Figure 2:
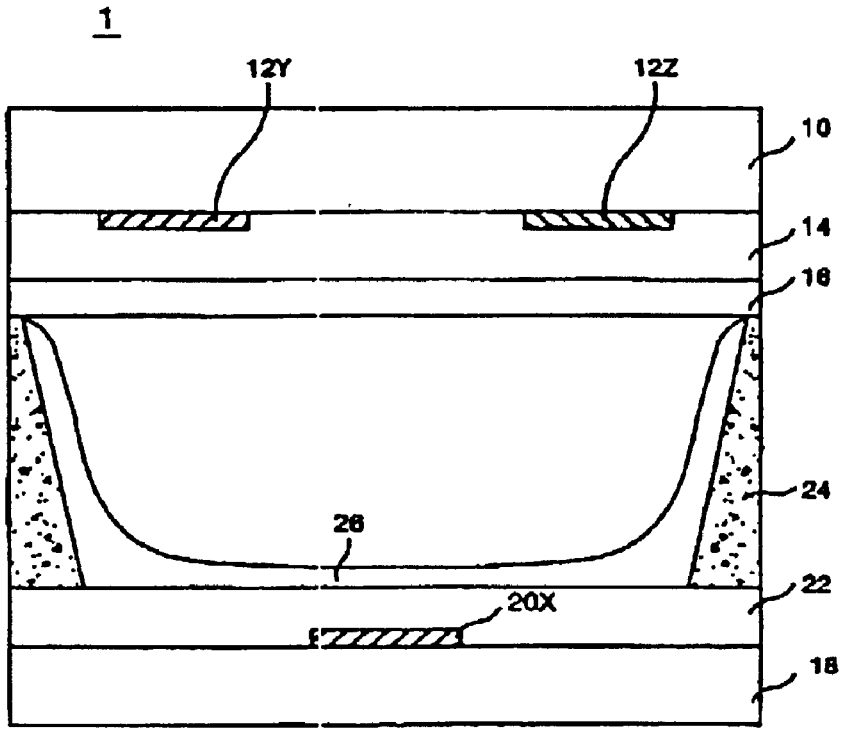
Fig. 2(Related Art)
FIG. 2 is a cross sectional view of the three-electrode AC surface discharge type PDP shown in FIG. 1.
Figure 3:
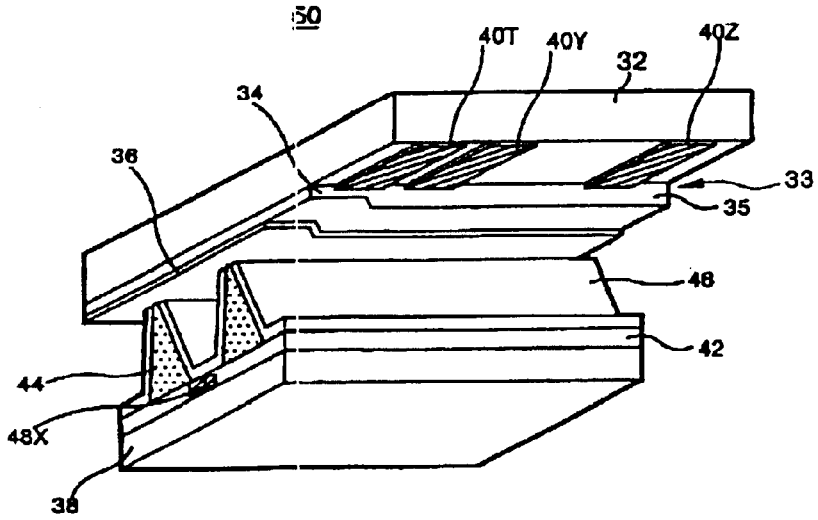
FIG. 3 is an exploded perspective view of the four-electrode AC surface discharge type PDP according to the first embodiment of the present invention.
Figure 4:
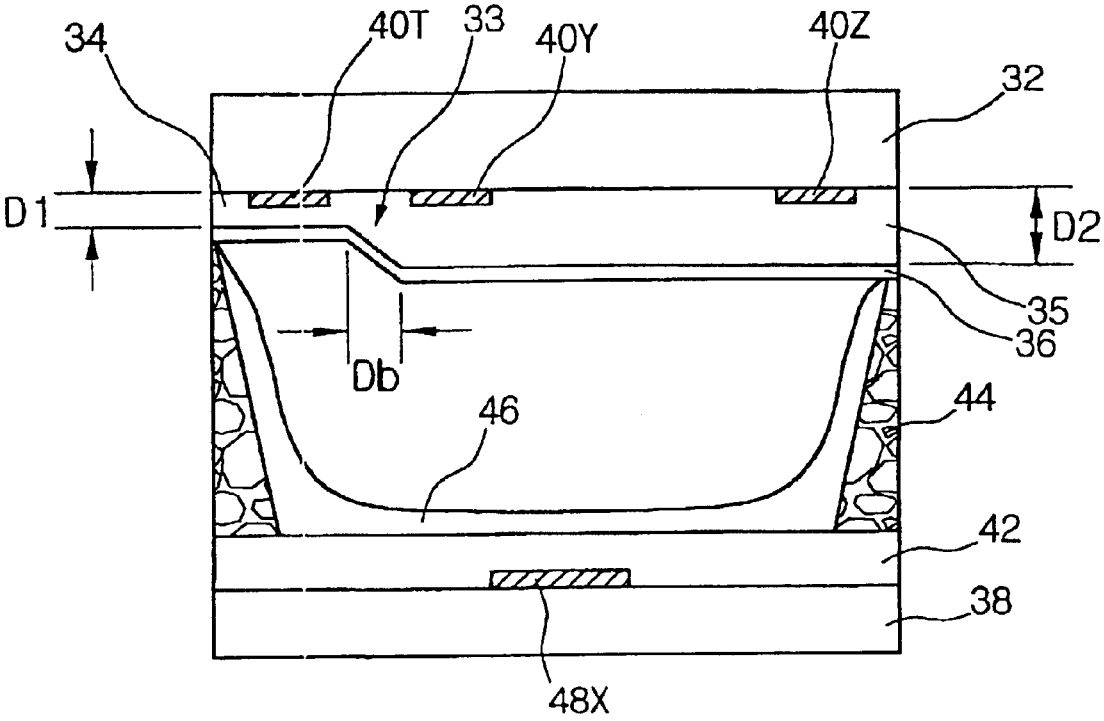
FIG. 4 is a cross sectional view of the four-electrode AC surface discharge type PDP shown in FIG. 3.

FIGS. 3 and 4 illustrate the structure of the four-electrode AC surface discharge type PDP according to the first embodiment of the present invention, respectively. FIG. 4 is a drawing in which a front substrate is turned by 90° to a rear substrate to describe a whole schematic structure of the discharge cells. Referring to the FIGS. 3 and 4, a four-electrode AC surface discharge type PDP according to the first embodiment of the present invention includes first electrodes 40T, second electrodes 40Y and third electrodes 40Z formed on a front substrate 32, and address electrodes 48X formed on a rear substrate 38.

It is desired that each of the first electrodes 40T is formed near to its neighboring second electrode 40Y while each of the third electrodes 40Z is formed spaced widely from its neighboring second electrodes 40Y The terms "near" and "spaced widely" mean "comparatively near" and "spaced comparatively widely" respectively among the electrodes 40T, 40Y and 40Z formed in one discharge cell 50. In other words, it is desired that the space between the second electrodes 40Y and the third electrodes 40Z is wider than the space between the first electrodes 40T and the second electrodes 40Y. Accordingly, note that not very important is how much the is space between the second electrodes 40Y and the third electrodes 40Z is wider than the space between the first electrodes 40T and the second electrodes 40Y.

A dielectric layer 33 is formed on the backsides of the first electrodes 40T, the second electrodes 40Y and the third electrodes 40Z. The dielectric layer 33 includes the first dielectric sub-layer 34 that is formed on the backside of the first electrodes 40T and covers the first electrodes 40T, and the second dielectric sub-layer 35 that is formed on the backsides of the second electrodes 40Y and the third electrodes 40Z and covers the second electrodes 40Y and the third electrodes 40Z. The first dielectric sub-layer 34 should cover the first electrodes 40T sufficiently, and the second dielectric sub-layer 35 should cover the second electrodes 40Y and the third electrodes 40Z sufficiently.

It is desired that the first dielectric sub-layer 34 is comparatively thinner than the second dielectric sub-layer 35. The first dielectric sub-layer 34 is 45 $\mu$m thick or less, and preferably, between 1 $\mu$m and 25 $\mu$m. The second dielectric sub-layer 35 is 50 $\mu$m thick or more, and preferably, between 50 $\mu$n and 60 $\mu$m. The thickness of the dielectric layer 33 gets gradually thicker with a predetermined slope at a boundary area (Db) between the first sub-dielectric layer and the second sub-dielectric layer as it goes from the first dielectric sub-layer 34 to the second dielectric sub-layer 35.

A protective latter 36 is laminated on the first dielectric sub-layer 34 and the second dielectric sub-layer 35. The protective layer 36 protects the first dielectric sub-layer 34 and the second dielectric sub-layer 35 from damages caused by sputtering during plasma discharge and also improves the second electrons emission efficiency. The protective layer 36 is usually made of magnesium oxide (MgO).

On the other hand, a rear dielectric layer 42 and barrier ribs 44 are formed on the rear substrate 38 that has the address electrodes 48X formed on it. A phosphor layer 46 covers over the surfaces of the rear dielectric layer 42 and the barrier ribs 44. The address electrodes 48X is formed in the direction to cross over the first electrodes 40T, the second electrodes 40Y and the third electrodes 40Z. Discharges are caused mainly on the cross section of the cross sections of the address electrodes 48X and any of the first electrodes 40T, the second electrodes 40Y and the third electrodes 40Z. The barrier ribs 44 are formed in parallel with the address electrodes 48X. In other words, each of the barrier ribs 44 is formed between the neighboring address electrodes 48X in parallel with the address electrodes 48X. Such barrier ribs 44 formed as described above prevent the ultraviolet rays and the visible rays generated by the plasma discharge in one discharge cell 50 from leaking into the neighboring discharge cells. The inert gas for discharge is injected into the discharge spaces prepared between the front substrate 32/the rear substrate 38 and the barrier ribs 44.

Now described is the operation of a PDP of the first preferred embodiment of the present invention as formed above.

First, in reset period, reset pulses are applied to any of the first electrodes 40T, the second electrodes 40Y and the third electrodes 40Z to cause reset discharge in the discharge cell 50.

Next, in address period, scan pulses are applied to the first electrodes 40T and data pulses are applied to the address electrodes 48X to cause address discharge in the discharge cell 50. Only the comparatively lower voltage is required to apply to the first electrodes 40T since the first dielectric sub-layer 34 formed to cover the first electrodes 40T is thin.

Then, in sustain period, first sustain pulses are applied to the second electrodes 40Y and second sustain pulses are applied to the third electrodes 40Z to cause sustain discharge between two electrodes 40Y and 40Z. The first sustain pulses and the second sustain pulses are alternatively applied to the second electrodes 40Y and the third electrodes 40Z. The second dielectric sub-layer 35 formed to cover the second electrodes 40Y and the third electrodes 40Z is formed to be thick. The sustain discharge causes the wall charge and the second dielectric sub-layer 35 help the wall charge be stored uniformly on the entire the second electrodes 40Y and the entire third electrodes 40Z so as to enhance the brightness very greatly.

In other words, in the PDP according to the first embodiment of the present invention, the first dielectric sub-layer 34 is formed on the backside of the first electrodes 40T to which scan pulses are applied while the second dielectric sub-layer 35 is formed on the backsides of the second electrodes 40Y and the third electrodes 40Z to which the first sustain pulses and the second sustain pulses are applied respectively. Thus, the lower driving voltage is applied in address period. On the other hand, it can cause sustain discharge so as to make the light emission efficiency be high.

Figure 5:
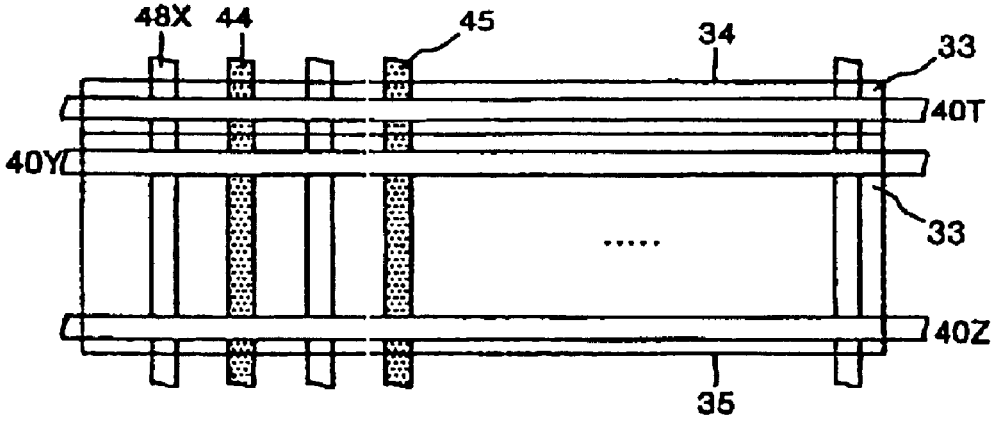
FIG. 5 illustrates formation of a dielectric layer of the four-electrode AC surface discharge type PDP shown in FIG. 3.

The dielectric layer 33 of the first embodiment as shown in FIG. 5 is arranged in stripe shape. In other words, the first dielectric sub-layer 34 is arranged in a stripe shape and parallel with the first electrodes 40T and the second dielectric sub-layer 35 is arranged in a stripe shape and parallel with the second electrodes 40Y and third electrodes 40Z.

On the other hand, the dielectric layer 52 may be formed in the discharge cells. This formation is kindly depicted in FIG. 6.

Figure 6:
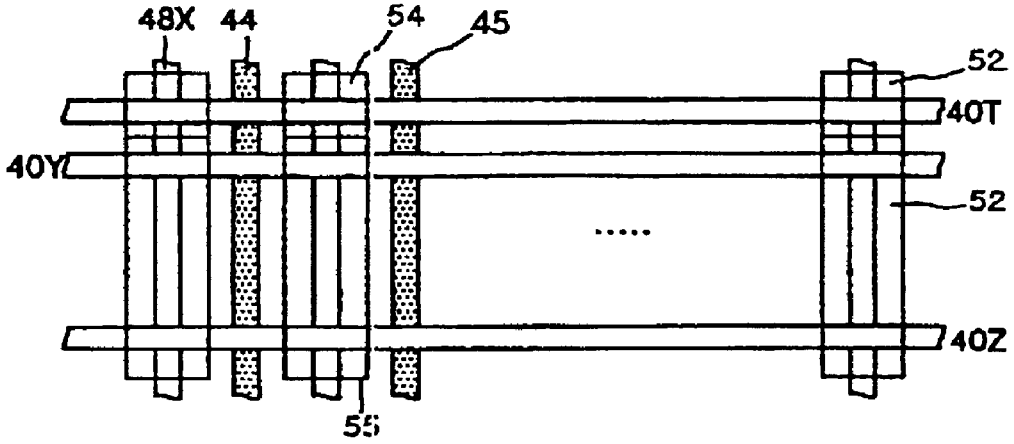
FIG. 6 illustrates formation of a dielectric layer of the four-electrode AC surface discharge type PDP according to the second embodiment of the present invention.

FIG. 6 illustrates formation of a dielectric layer of the four-electrode AC surface discharge type PDP according to the second embodiment of the present invention. Referring to FIG. 6, in the second preferred (embodiment of the present invention, the first dielectric sub-layer 54 is thinner than the second dielectric sub-layer 55. They are formed only on discharge cells between the neighboring barrier ribs 44 and 45. So, it allows us to cut down on consumption of dielectric materials for the dielectric layer so as to lower the price of the goods including this invention.

Figure 7:
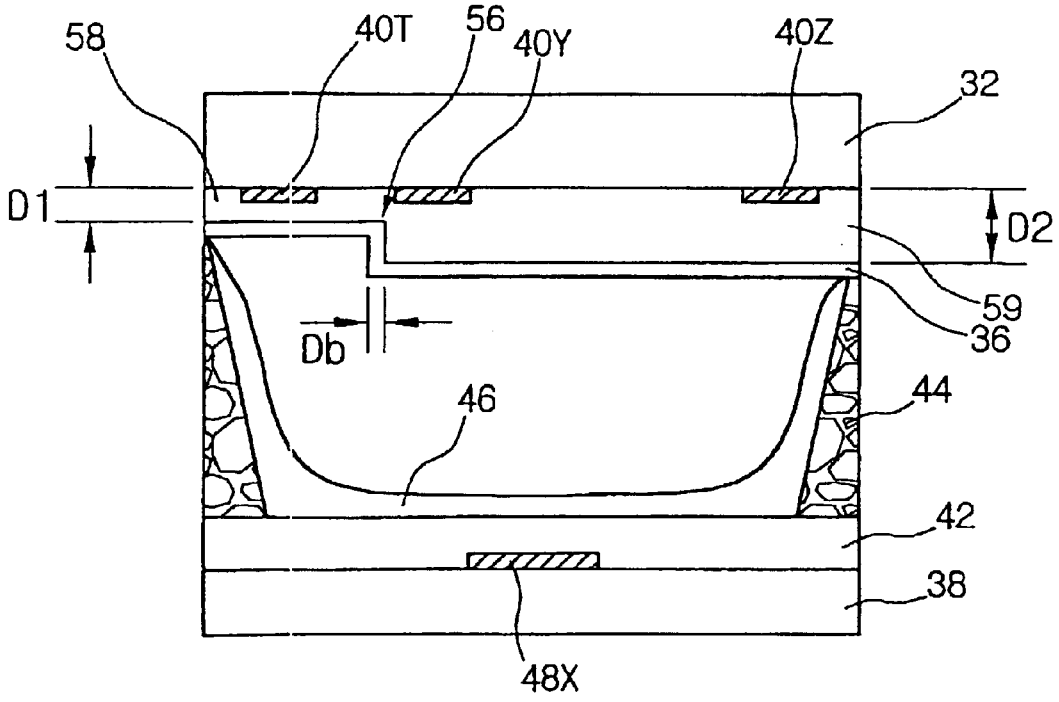
FIG. 7 is a cross sectional view of the four-electrode AC surface discharge type PDP according to the third embodiment of the present invention.

FIG. 7 is a cross sectional view of the four-electrode AC surface discharge type PDP according to the third embodiment of the present invention. Referring to FIG. 7, in the second preferred embodiment of the present invention, the dielectric layer 56 includes the first dielectric sub-layer 58 formed on the backside of the first electrodes 40T and the second dielectric sub-layer 59 formed on the backsides of the second electrodes 40Y and the third electrodes 40Z. It is desirable that the first dielectric sub-layer 58 is thinner than the second dielectric sub-layer 59. A stiff step is formed in the boundary areas Db of the first dielectric sub-layer 58 and the second dielectric sub-layer 59. Not important is where between the first electrodes 40T and the second electrodes 40Y the stiff step is located.

As described above, according to the plasma display panel of the present invention, the first dielectric sub-layer formed on the backside of the first electrodes that receives the scan pulses is so thin to lower the voltage level of the driving pulses in address period.

According to the plasma display panel of the present invention, the second dielectric sub-layer formed on the backsides of the second electrodes and the second electrodes that receive the sustain pulses is so thicker to store the wall charge uniformly on the electrodes in sustain period to improve light emission efficiency.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel, comprising:

a plurality of first electrodes formed on a front substrate, for receiving scan pulses during address period;

a plurality of second electrodes formed near to each of the first electrodes, for receiving first sustain pulses during sustain period;

a plurality of third electrodes formed spaced widely from each of the second electrodes, for receiving second sustain pulses during sustain period;

a dielectric layer having a first dielectric sub-layer and a second dielectric sub-layer, the first dielectric sub-layer being formed on a backside of the first electrodes, the second dielectric sub-layer being formed on backsides of the second electrodes and the third electrodes, the first dielectric sub-layer being different from the second dielectric sub-layer in thickness;

a plurality of address electrodes formed on a rear substrate in a direction to cross over the first electrodes, the second electrodes and the third electrodes; and a plurality of barrier ribs; formed between the neighboring address electrodes and parallel with the address electrodes.

2. The plasma display panel according to claim 1, wherein the first dielectric sub-layer is thinner than the second dielectric sub-layer.

3. The plasma display panel according to claim 2, wherein the first dielectric sub-layer is 45 $\mu$m thick or less.

4. The plasma display panel according to claim 2, wherein the second dielectric sub-layer is 50 $\mu$m thick or more.

5. The plasma display panel according to claim 2, wherein the first dielectric sub-layer is arranged in a stripe share and parallel with the first electrodes.

6. The plasma display panel according to claim 1, wherein the second dielectric sub-layer is arranged in a stripe shape and parallel with the second electrodes and third electrodes.

7. The plasma display panel according to claim 1, wherein the first dielectric sub-layer and the second dielectric sub-layer are formed only in discharge cells when each of the discharge cells between the neighboring barrier ribs is formed on the cross sections of the address electrodes and any of the first electrodes, the second electrodes and third electrodes.

8. The plasma display panel according to claim 1, wherein the dielectric layer gets gradually thicker with a predetermined slope at a boundary area between the first sub-dielectric layer and the second sub-dielectric layer as it goes from the fist dielectric sub-layer to the second dielectric sub-layer.

9. The plasma display panel according to claim 1, wherein the dielectric layer gets abruptly thicker with a stiff step at a boundary area between the first sub-dielectric layer and the second sub-dielectric layer as it goes from the first dielectric sub-layer to the second dielectric sub-layer.

10. A plasma display panel, comprising:

a plurality of first electrodes formed on a front substrate, for receiving scan pulses during address period;

a plurality of second electrodes formed near to each of the first electrodes, for receiving first sustain pulses during sustain period;

a plurality of third electrodes formed spaced widely from each of the second electrodes, for receiving second sustain pulses during sustain period;

a dielectric layer having a first dielectric sub-layer and a second dielectric sub-layer, the first dielectric sub-layer being formed on a backside of the first electrodes, the second dielectric sub-layer being formed on backsides of the second electrodes and the third electrodes, the dielectric layer getting gradually thicker with a predetermined slope at a boundary area between the first sub-dielectric layer and the second sub-dielectric layer as it goes from the first dielectric sub-layer to the second dielectric sub-layer;

a plurality of address electrodes formed on a rear substrate in a direction to cross over the first electrodes, the second electrodes and the third electrodes; and a plurality of barrier ribs formed between the neighboring address electrodes and parallel with the address electrodes.

11. The plasma display panel according to claim 10, wherein the first dielectric sub-layer is 45 $\mu$m thick or less.

12. The plasma display panel according to claim 10, wherein the second dielectric sub-layer is 50 $\mu$m thick or more.

13. The plasma display panel according to claim 10, wherein the first dielectric sub-layer is arranged in a stripe shape and parallel with the first electrodes.

14. The plasma display panel according to claim 10, wherein the second dielectric sub-layer is arranged in a stripe shape and parallel with the second electrodes and the third electrodes.

15. A plasma display panel, comprising:

a plurality of first electrodes formed on a front substrate, for receiving scan pulses during address period;

a plurality of second electrodes formed near to each of the first electrodes, for receiving first sustain pulses during sustain period;

a plurality of third electrodes formed spaced widely from each of the second electrodes, for receiving second sustain pulses during sustain period;

a dielectric layer having first dielectric sub-layer and second dielectric sub-layer, the first dielectric sub-layer being formed on a backside of the first electrodes, the second dielectric sub-layer being formed on backsides; of the second electrodes and the third electrodes, the dielectric layer getting abruptly thicker with a stiff step at a boundary area between the first sub-dielectric layer and the second sub-dielectric layer as it goes from the first dielectric sub-layer to the second dielectric sub-layer in their boundary areas, the first dielectric sub-layer being thinner than the second dielectric sub-layer;

a plurality of address electrodes formed on a rear substrate in a direction to cross over the first electrodes, the second electrodes and the third electrodes; and a plurality of barrier ribs formed between the neighboring address electrodes and parallel with the address electrodes.

16. The plasma display panel according to claim 15, wherein the first dielectric sub-layer is 45 $\mu$m thick or less.

17. The plasma display panel according to claim 15, wherein the second dielectric sub-layer is 50 $\mu$m thick or more.

18. The plasma display panel according to claim 15, wherein the first dielectric sub-layer and the second dielectric sub-layer are formed only in discharge cells between the neighboring barrier ribs.

19. A plasma display panel, comprising:

a plurality of first electrodes formed on a front substrate, for receiving scan pulses during address period;

a plurality of second electrodes formed near to each of the first electrodes, for receiving first sustain pulses during sustain period;

a plurality of third electrodes formed spaced widely from each of the second electrodes, for receiving second sustain pulses during sustain period;

a dielectric layer having first dielectric sub-layer and second dielectric sub-layer, the first dielectric sub-layer being formed on a backside of the first electrodes, the second dielectric sub-layer being formed on backsides of the second electrodes and the third electrodes, the first dielectric sub-layer being thinner than the second dielectric sub-layer in their thickness, the first dielectric sub-layer and the second dielectric sub-layer being formed only in discharge cells between the neighboring barrier ribs;

a plurality of address electrodes formed on a rear substrate in a direction to cross over the first electrodes, the second electrodes and the third electrodes; and a plurality of barrier ribs formed between the neighboring address electrodes and parallel with the address electrodes.

20. The plasma display panel according to claim 19, wherein the first dielectric sub-layer is 45 $\mu$m thick or less.

21. The plasma display panel according to claim 19, wherein the second dielectric sub-layer is 50 $\mu$m thick or more.

* * * * *